US005529199A

United States Patent [19]

Foster

[11] Patent Number: 5,529,199

[45] Date of Patent: Jun. 25, 1996

[54] CONTAINER CAPABLE OF DISASSEMBLY INTO AN INTEGRAL UNIT FOLLOWING USE

[76] Inventor: Hensley Foster, N144 W14315 Pioneer Rd., Jackson, Wis. 53037

[21] Appl. No.: 393,062

[22] Filed: Feb. 22, 1995

[51] Int. Cl.[6] ..... B65D 19/18

[52] U.S. Cl. ..... 220/4.28; 220/4.33

[58] Field of Search ..... 220/4.28, 4.33, 220/666, 668, 677, 693

[56] References Cited

U.S. PATENT DOCUMENTS

| | | | |
|---|---|---|---|
| 1,119,503 | 12/1914 | Frank . | |
| 1,717,137 | 6/1929 | Barton . | |
| 1,828,088 | 10/1931 | Robinson | 220/4.33 X |
| 1,932,772 | 10/1933 | Eschenbach . | |
| 2,613,834 | 10/1952 | Gill et al. . | |
| 2,729,355 | 1/1956 | Gaston . | |
| 2,775,360 | 12/1956 | Phillips . | |
| 3,138,398 | 6/1964 | Silverman | 220/4.28 X |
| 3,182,846 | 5/1965 | La Kaff | 220/4.28 |
| 3,266,656 | 8/1966 | Kridle | 220/4.28 |
| 3,572,535 | 3/1971 | Kinzic | 220/4.33 |
| 3,722,928 | 3/1973 | Skubic . | |
| 3,799,382 | 3/1974 | Munroe . | |
| 3,966,285 | 6/1976 | Porch et al. | 220/4.28 X |
| 3,989,157 | 11/1976 | Veenema . | |
| 4,210,274 | 7/1980 | Leonard . | |
| 4,643,314 | 2/1987 | Kidd . | |
| 4,969,567 | 11/1990 | Rogers | 220/4.33 |
| 5,289,937 | 3/1994 | Boots | 220/666 X |

FOREIGN PATENT DOCUMENTS

| | | |
|---|---|---|
| 2202920 | 8/1973 | Germany . |
| 298009 | 4/1954 | Switzerland . |
| 634138 | 3/1950 | United Kingdom . |

*Primary Examiner*—Steven M. Pollard
*Attorney, Agent, or Firm*—Andrus, Sceales, Starke & Sawall

[57] ABSTRACT

A container has an assembled condition in which it is used for transport or storage of goods and a disassembled condition in which the elements of the container are collected into an integral unit. The container comprises top and bottom members. Columnar members are received in the top and bottom members when the case is in the assembled condition. The columnar members have at least a pair of peripherally spaced slots extending along the columnar members. Each of a plurality of side members are inserted in a slot of a columnar member in one corner of the top and bottom members and in a slot in a columnar member positioned in an adjacent corner to form one of the sides of the container. A locking device releasably retains the columnar members in the top and bottom members. For this purpose, the locking devices contain locking members for releasably trapping projections on the columnar members. When the container is disassembled, the columnar members and side members may be stored inside the top and bottom members. The top and bottom members are jointed together so that the disassembled container forms an integral unit.

13 Claims, 3 Drawing Sheets

FIG. 3
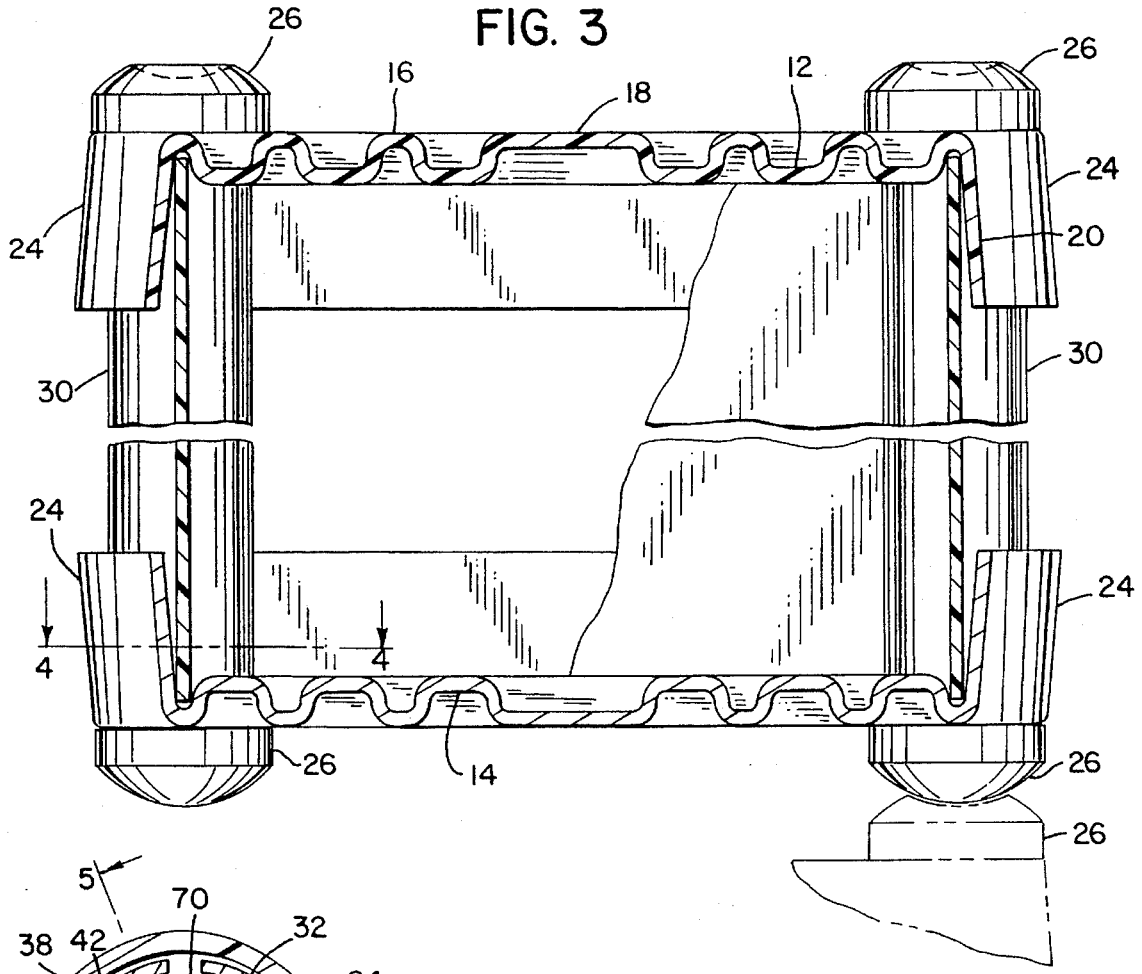
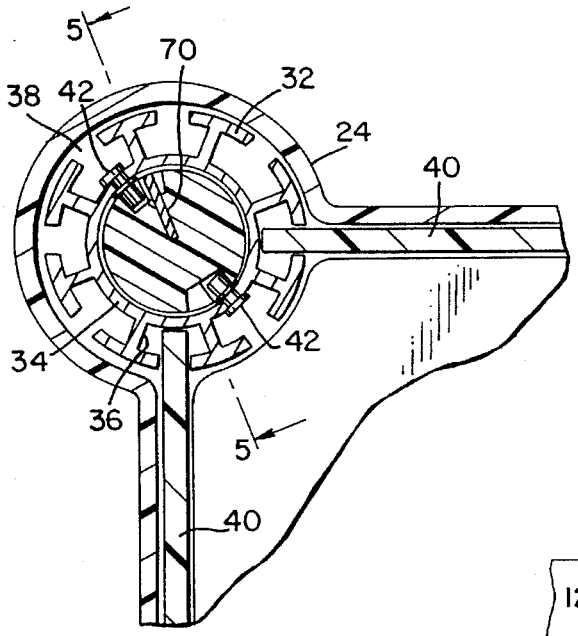
FIG. 4
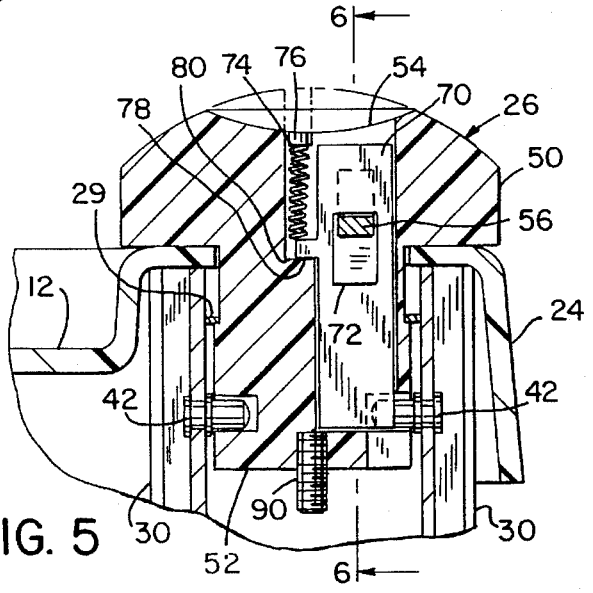
FIG. 5

CONTAINER CAPABLE OF DISASSEMBLY INTO AN INTEGRAL UNIT FOLLOWING USE

BACKGROUND OF THE INVENTION

The present invention relates to a container that can be disassembled following use. Such a container is typically used for shipping goods. After the container with the goods reaches its destination and the goods are removed from the container, the container may be disassembled. The disassembled container is stored or returned to the point of origin for reassembly and reuse.

The advantages of containers that can be set up, used for the storage or shipping of goods or for other purposes, and thereafter disassembled until reuse is desired are well known. These include the economy attendant reusability and the benefits arising from compactness in storage and return shipment when the container is in the disassembled condition.

In order to fully achieve these advantages, it is necessary for such a container to possess a high degree of durability. This is required so that the container can be used a sufficient number of times to offset any additional cost in making the container such that it can be disassembled. It is also required so that the container can withstand the loads to which it is subjected in use. It is also desirable that the container be light in weight so as to reduce shipping costs and facilitate handling.

It is further desirable that the container collapse to the maximum extent possible when disassembled, so that the compactness advantage is maximized. Further, it is also desirable that the container disassemble in an easy manner and form an integral unit when in the disassembled condition. This prevents loss of parts of the container when it is not in use.

The need to provide a container that is serviceable and light weight in the assembled condition yet can be easily disassembled to a compact size when desired places unique demands on the design and construction of such a container and its components.

SUMMARY OF THE INVENTION

It is therefore the object of the present invention to provide a container of the foregoing type that achieves the foregoing objects.

Briefly, the present invention comprises a container having an assembled condition in which it is used for transport or storage and a disassembled condition in which the elements of the container are collected into an integral unit. The container comprises top and bottom members, each having central wall portions, peripheral side wall portions, and receptacles formed in the corners of the members. Columnar members are received in the receptacles in the top and bottom members when the case is in the assembled condition. The columnar members have at least a pair of peripherally spaced slots extending along the columnar members. A side member for the container is inserted in a slot of a columnar member in one corner of the top and bottom members and in a slot in a columnar member positioned in an adjacent corner of the top and bottom members to form a side of the container. Other sides of the container are formed in a similar manner. Locking device releasably retain the columnar members, and hence the side members, on the top and bottom members. For this purpose, the locking devices contain locking members for releasably trapping projections on the columnar members in the devices.

When the container is disassembled, the columnar members and side members may be stored inside the top and bottom members, the top and bottom members are jointed together so that the disassembled container forms an integral unit.

BRIEF DESCRIPTION OF THE DRAWINGS

The present invention will be further understood by reference to the accompanying drawings showing an exemplary embodiment thereof.

FIG. 3 is a cross-sectional view of the container in the assembled condition taken along the line 3—3 of FIG. 1;

FIG. 4 is a cross-sectional view taken along the line 4—4 of FIG. 3;

FIG. 5 is a cross-sectional view taken substantially along the line 5—5 of FIG. 4 showing one of the locking devices used to maintain the container in an integral condition in both the assembled and disassembled conditions and showing the device in the locked condition;

DETAILED DESCRIPTION OF THE PREFERRED EMBODIMENT

Figure 1:
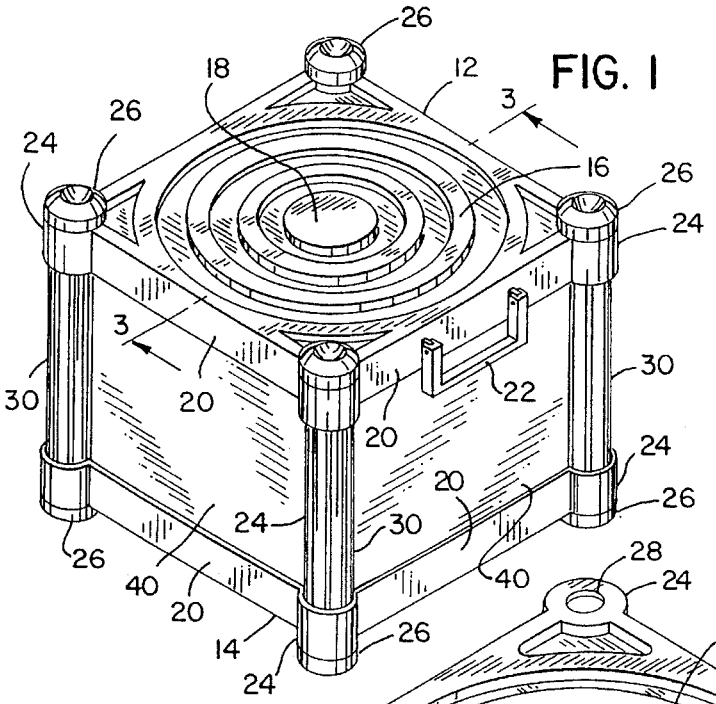
FIG. 1 is a perspective view of the container of the present invention in the assembled condition.
Figure 2:
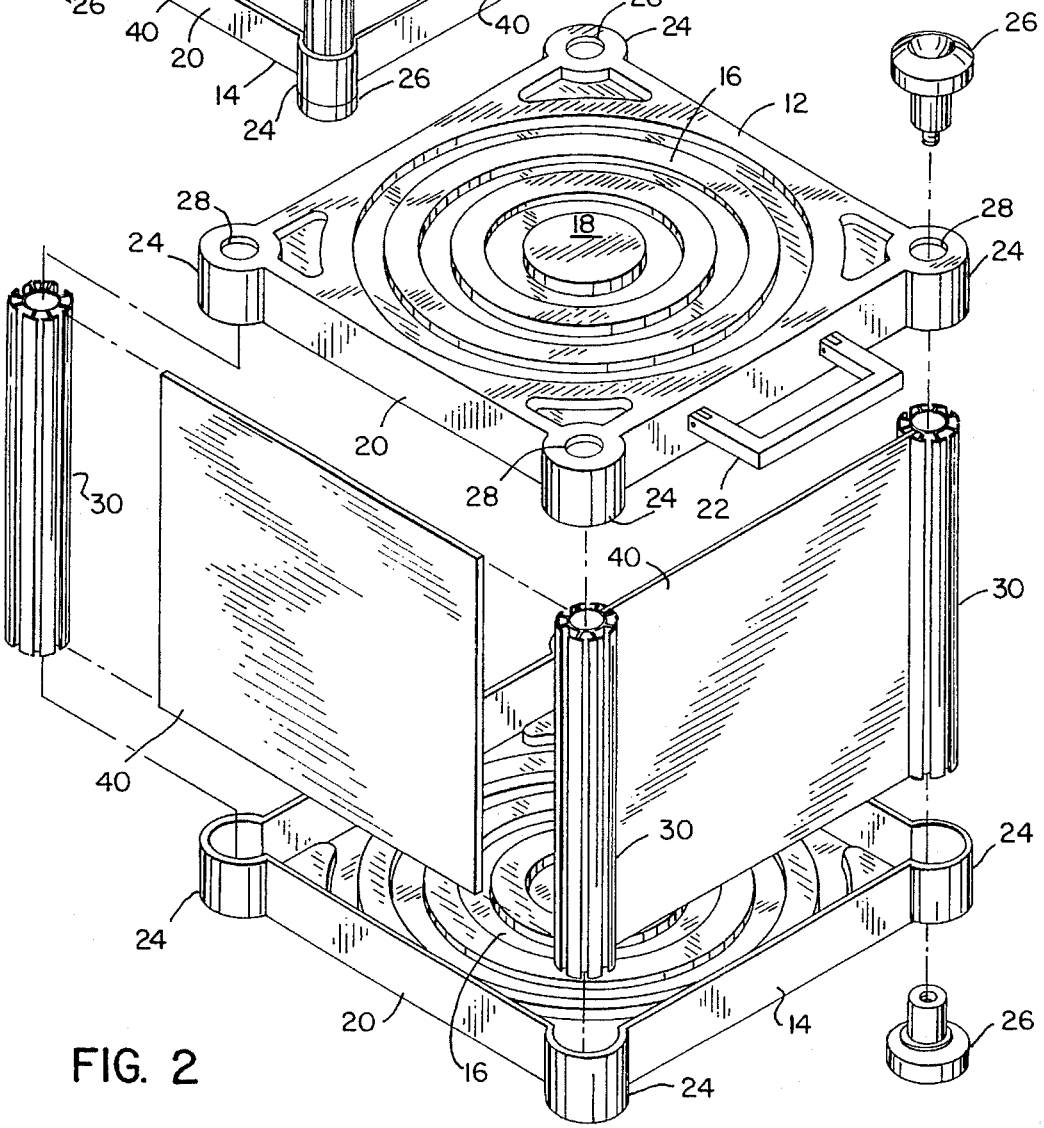
FIG. 2 is an exploded view of the container showing certain elements thereof and the manner in which the container is disassembled.

Referring now to FIGS. 1 and 2, container 10 of the present invention includes top member 12, and bottom member 14. Top and bottom members 12, 14, may be formed of a suitable material, such as metal or plastic. The central portions of top and bottom members 12, 14 are preferably formed to have a plurality of concentric reinforcing ribs 6 and a raised center portion 18. These serve to stiffen the central portions of the top and bottom members. Side walls 20 extend from the edges of the top and bottom members. A handle 22 for carrying container 10 in both the assembled and disassembled states may be provided on one of the side walls.

Figure 6:
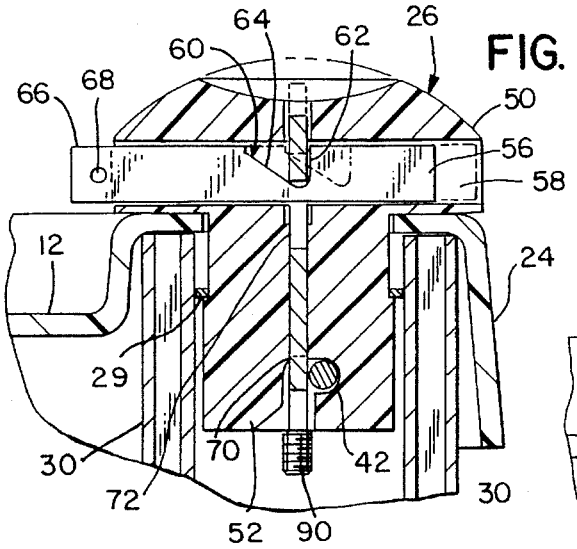
FIG. 6 is a cross-sectional view taken along the line 6—6 of FIG. 5.
Figure 7:
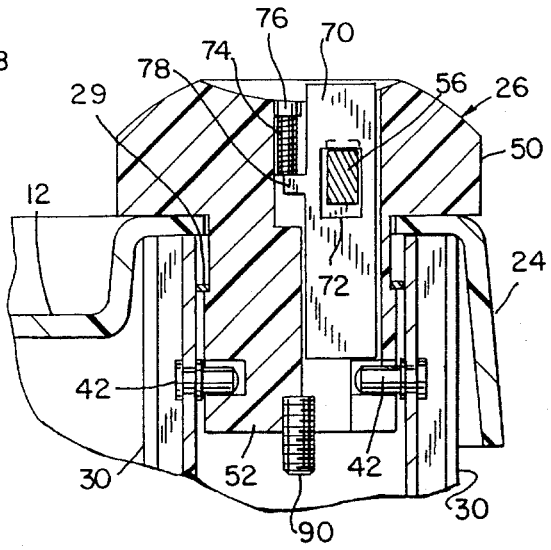
FIG. 7 is a cross-sectional view, similar to FIG. 5, but showing the locking device in the unlocked condition.

At the corners of top and bottom members 12, 14, the side walls 20 are formed into partially cylindrical, receptacle portions 24. A locking device 26, hereinafter described in detail, passes through a hole 28 in each of the partially cylindrical portions 24, as shown most clearly in the exploded view of FIG. 2. Locking devices 26 may be captured within cylindrical portion 24 by retaining rings 29, as shown in FIGS. 5 through 7 and in FIG. 11 so that the locking devices are retained in holes 28.

A corner columnar member 30 is positioned in the partially cylindrical, receptacle portion 24 in each of the corners of the top and bottom members 12 and 14. The perimeter dimension of columnar members 30 is sized so that the columnar members may be received in the partially cylindrical, receptacle portions 24 of the side walls 20 of the top and bottom members 12, 14, as shown in FIGS. 3 and 4.

As shown most clearly in the cross-sectional view of FIG. 4, each of the columnar members 30 may be circular in cross-sectional configuration with exterior peripheral surface elements 32, a cylindrical core member 34, and spacers 36 connecting peripheral surface elements 32 to central core member 34.

Peripheral surface elements 32 form slots 38 running the length of columnar member 30 and lying circumferentially between each pair of spacers 36. The slots are arranged on the circumference of columnar member 30 so that at least one pair of slots are arcuately displaced by an angle of 90°.

Side members 40 of collapsible container 10 are received in slots 38 in columnar members 30, as shown in FIGS. 2 and 4 of the drawing. Thus, a pair of side members 40 are placed in slots 38 of a given columnar member 30 which are arcuately displaced by an angle of 90°. The same is true for the remaining side walls and columnar members 30 of container 10. Side members 40 fit inside side walls 20 of top and bottom members 12, 14.

Side members 40 of collapsible container 10 may be formed of a suitable material such as metal or plastic. The same is true with respect to columnar member 30.

As shown in FIGS. 4 and 5, a plurality of studs 42 are mounted on cylindrical core member 34 of each columnar member at diametrically opposed positions. The studs extend inwardly of the core member. A pair of such studs is mounted adjacent both ends of each columnar member 30.

Studs 42 engage locking device 26. Each of locking devices 26 is formed with a cap 50 and a cylindrical body 52. The cylindrical body 52 of the locking device passes through hole 28 in partially cylindrical, receptacle portion 24, of top or bottom members 12, 14. Cylindrical body 52 contains an exterior groove for receiving retaining ring 29 that retains the locking device in hole 28. Cylindrical body 52 is sized to fit inside cylindrical core member 34.

Each of caps 50 for locking device 26 mounted on top member 12 are formed with a cavity 54. Caps 50 of the locking devices 26 mounted in bottom member 14 are convexly curved. This enables a plurality of containers 10 to be conveniently stacked, in the manner shown in FIG. 3. Container 10 may be stacked in either the assembled or disassembled condition.

As shown most clearly in FIG. 6, bar 56 extends through hole 58 transversely across cap 50. Bar 50, and hole 58, are preferably square or rectangular. Also as shown in FIG. 6, bar 56 is transversely movable in hole 58. Bar 56 includes triangularly shaped notch 60 in the central portion thereof. Triangularly shaped notch 60 includes a generally vertical side wall 62 and a ramp portion 64. The portion 66 of bar 56 that is exposed when the bar is positioned as shown in solid lines in FIG. 6, may contain a hole 68 for a pin or other member that serves to retain bar 56 in the position shown in FIG. 6.

Locking device 26 contains a vertical slot in which is mounted locking plate 70. The edge of locking plate 70 is shown in FIG. 6 and the flat surface of the plate is shown in FIG. 7. The slot in which plate 70 is mounted is open at the top and extends partially through locking device 26. This enables the plate to be inserted in the slot from the top of the locking device 26.

Locking plate 70 contains hole 72. Bar 56 extends through hole 72 so that the upper portion of locking plate 70 rests in triangular notch 60, as shown in FIG. 6.

When locking device 26 is oriented as shown in FIG. 6, locking plate 70 is downwardly biased by compression spring 74 inserted in a groove adjacent the slot in which plate 70 rides and retained therein by plug 76. The lower end of spring 74 rests on projection 78 of plate 70. The downward movement of plate 70 may be arrested by the abutment of projection 78 with lip 80 formed in the slot containing plate and by the abutment of the upper portion of locking plate 70 with bar 56.

In the normal condition, plate 70 is in the lowered position shown in FIGS. 5 and 6 in which the upper portion of plate 70 rests at or near the bottom of triangular notch 60 and adjacent vertical wall 62.

Plate 72 is moved upwardly against the force of spring 74 by moving bar 56 to the right, as shown in FIG. 6. This causes plate 70 to ride upwardly along ramp surface 64 of triangular notch 60 to the position shown in FIG. 7.

Figure 8:
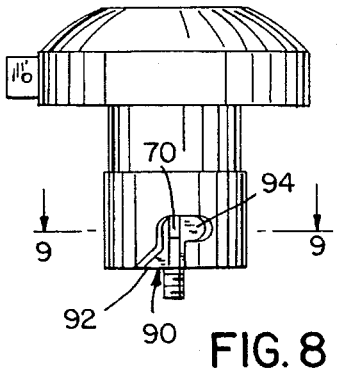
FIG. 8 is a side view of the locking device.
Figure 9:
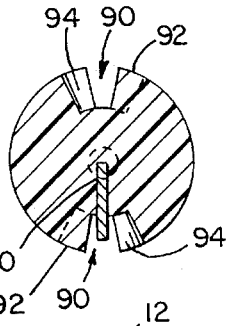
FIG. 9 is a cross-sectional view taken long the line 9—9 of FIG. 8.

Two keyways 90 are provided on the cylindrical body 52 of each locking device 26, at generally diametrically opposed positions. As shown in FIGS. 8 and 9, each of the keyways 90 contains an entry portion 92, one surface of which may slope downwardly and outwardly when the locking device is oriented as shown in FIG. 8. Entry portion 92 leads to a circumferential groove portion 94.

As shown in FIGS. 5 through 8, keyways 90 receive pins 42 mounted on columnar members 30. Also as shown in FIGS. 4 through 8, locking plate 70 extends into circumferential groove portion 94. When the locking plate is in the lowered position, it may be used to trap one of studs 42 in the end of circumferential groove portion 94, as shown in FIGS. 4, 5, and 6. This retains locking device 26 on columnar member 30. When locking plate 70 is in the raised position, studs 42 are free to move in groove portion 94. This enables locking device 26 to be released from columnar member 30 when the studs are moved to entry portion 92. When locking plate 70 is subsequently lowered, stud 42 is prevented from entering and becoming trapped in circumferential groove portion 94, thereby ensuring that locking device is not inadvertently retained on columnar member 30. When stud 42 is not trapped in circumferential groove portion 94, locking device 26 can be removed from the columnar member 30.

To assemble container 10, a columnar member 30 is placed in the partially cylindrical, receptacle portion 24 at each of the corners of bottom member 14. The cylindrical body 52 of the locking device 26 at each corner is inserted inside central core member 34 of the respective columnar member 30. Locking device 26 is rotated until studs 42 are aligned with the entry portions 92 of keyways 90. Locking device 26 is then moved inwardly in columnar member 34 to place pins 42 in alignment with circumferential groove portions 94 of keyways 90. Bar 56 is moved laterally to the position shown in dotted lines in FIG. 6. This draws locking plate 70 outwardly in the locking device, from the position shown in FIGS. 5 and 6 to the position shown in FIG. 7, as the outer portion of locking plate 70 rides along ramp surface 64 against the bias of spring 74. In such a position, locking plate 70 does not block relative movement between stud 42 and locking device 26. Locking device 26 is then rotated to move studs 42 into the ends of circumferential groove portions 94. Bar 56 is then released. The force of spring 74 on projection 78 urges locking plate 70 inwardly, restoring bar 56 to the position shown in solid lines in FIG. 6 and moving locking plate 70 into groove portion 94 so that it traps one of the studs 42 in the end of one of the circumferential groove portions 94 into which locking plate 70 extends. Locking device 26, and hence bottom member 14, is thus locked to studs 42 and to columnar member 30. This retains bottom member 14 and columnar member 30 together.

The process is repeated at each of the remaining three corners of container 10.

Thereafter, side members 40 are slid into slots 38 in the manner shown in FIGS. 2 and 4 to rest inside side walls 20 of bottom member 14. The goods to be stored or shipped in container 10 may then be placed in the container. Top member 12 is then positioned on the container so that the partially cylindrical, receptacle portions 24 of top wall 14 embrace the upper portions of columnar members 30 and side walls 20 embrace side members 40. Top member 12 is secured to collapsible container 10 by locking devices 26 in the manner shown in FIGS. 4–7, and described, in detail, above. Container 10 is then ready for shipment or storage.

To disassemble container 10, locking devices 26 are released from studs 42 of each of columnar members 30. To carry out this, bar 56 is laterally moved to the position shown in dotted lines in FIG. 6. This causes locking plate 70 to move outwardly in locking device 26 as the upper portion of the locking plate rides along ramp surface 64 against the bias of spring 74. With locking plate 70 in the outward position, as shown in FIG. 7, studs 42 are no longer trapped in circumferential grooves 94 of locking devices 26. The locking device can then be rotated to move studs to entry portion 92 of keyway 90. Bar 56 may then be released. The force applied by spring 74 urges locking plate 70 inwardly, moving bar 56 to the position shown in solid lines in FIG. 6 as the upper portion locking plate 70 moves downwardly along ramped portion 64. With locking plate 70 again in the lowered position, pins 42 are retained in the entry portions 92 of keyways 90. This allows cylindrical body 52 of locking device 26 to be removed from central core member 34 of columnar member 30.

When all locking devices 26 on top member 12 have been manipulated to release the locking devices from the respective columnar members 30, top member 12 is lifted off container 10 and the goods removed from the container. Side members 40 are slid out of slots 38. Locking devices 26 on bottom wall 14 are then manipulated to release columnar members 30 from the bottom wall.

Figure 10:
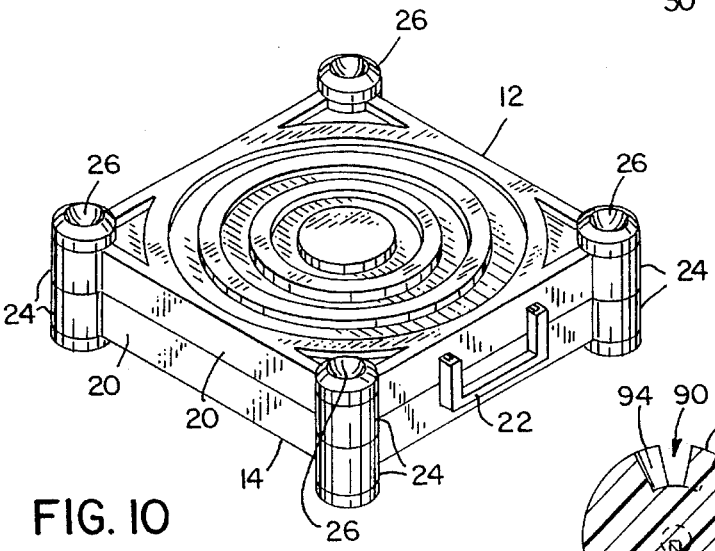
FIG. 10 is a perspective view showing the container in the disassembled condition.
Figure 11:
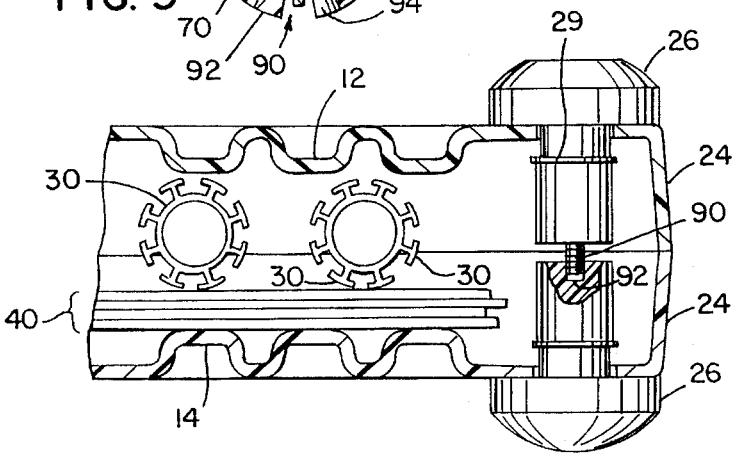
FIG. 11 is a partial cross-sectional view of the container showing the manner which it is maintained as an integral unit in the disassembled condition.

Side members 40 and columnar members 30 are placed on bottom wall 14, as shown in FIG. 11. Thereafter, top member 12 is placed on bottom member 14, as shown in FIGS. 10 and 11. Cylindrical bodies 52 of the locking device 26 associated with one of the top and bottom walls 12, 14, contain threaded studs 95. Cylindrical bodies 52 of locking devices 26 associated with the other of top member 12 or bottom member 14 contain a mating threaded bore 96. With the top and bottom members 12 and 14 in the position shown in FIGS. 10 and 11, locking devices 26 are rotated to engage threaded studs 95 in one of the locking devices in the threaded bores 96 in the other of the locking devices. The engagement of locking devices 26 at the corners of disassembled container 10 retains the top and bottom members 12, 14, in an integral unit with columnar members 30 and side members 40 stored within the disassembled container. In this condition, container 10 may be returned to the point of origin for reassembly and reuse or may be stored until further use of the container is required.

Figure 12:
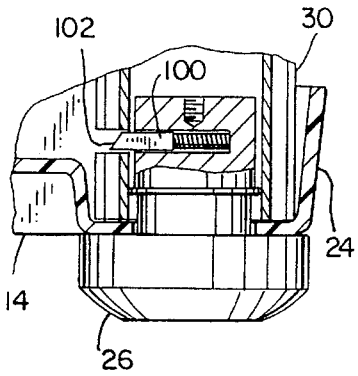
FIG. 12 is a cross-sectional view showing a modification of the locking devices used in the container of the present invention.

FIG. 12 shows another technique by which columnar members 30 may be retained on locking devices 26. The locking device 26 show in FIG. 12 has spring loaded pin 100 which engages hole 103 in columnar member 30 to retain the columnar member on the locking device. Pin 100 may be bevelled at its outer end to facilitate placing columnar member 30 on locking device 26. Columnar member 30 can be detached from locking device 26 by pressing the end of pin 100 inward with a nail or similar object.

Various modes of carrying out the invention are contemplated as being within the scope of the following claims particularly pointing out and distinctly claiming the subject matter which is regarded as the invention.

I claim:

1. A container having an assembled condition in which the container is used and a disassembled condition in which the elements of the container are collected into an integral unit, said container comprising:

a top member having a central wall portion, peripheral side wall portions extending from said central wall portion, and corners, a receptacle being formed in each of said corners of said top member and extending normal to the central wall portion of said top member;

a bottom member having a central wall portion, peripheral side wall portions extending from said central wall portion, and corners, a receptacle being formed in each of the corners of each of the bottom member and extending normal to the central wall portion, the receptacles formed in said top and bottom members being aligned, providing aligned pairs when said top and bottom members are placed in a position in which said peripheral wall portions of each member extend toward each other;

a columnar member received in each of said aligned pairs of receptacles in said top and bottom members when said case is in the assembled condition, each of said columnar members extending from one of said receptacles in said top member to a corresponding one of said receptacles in the bottom member, each of said columnar members having at least a pair of peripherally spaced slots extending along said columnar members parallel to the axis thereof;

a plurality of side members having ends, each of said side members having one end inserted in a slot in a columnar member in one corner of said top and bottom members and another end inserted in a slot in a columnar member positioned in a corner adjacent to said one corner so that each of said side members extends between two adjacent corners of said top and bottom members; and locking devices engaged internally of said columnar members for releasably retaining said columnar members in said receptacles in said top and bottom members when said container is in the assembled condition, said peripheral side walls of said top and bottom members being placed in abutment when said container is in the disassembled condition, said locking devices of said top and bottom members being contiguous when said peripheral side wall portions of said top member and bottom member are placed in abutment, said locking devices containing means for releasably securing said locking devices together, when contiguous to retain the top member and the bottom member in an integral unit when said container is in the disassembled condition, said columnar members and side members being storable within the top and bottom members when the container is in the disassembled condition.

2. The container according to claim 1 wherein said columnar members are generally circular in cross-section.

3. The container according to claim 1 wherein each of said columnar members has more than two peripherally spaced slots extending along the columnar member.

4. The container according to claim 2 wherein said corner receptacles of said top and bottom walls are at least partially cylindrical.

5. The container according to claim 1 wherein each of said locking devices comprises a body extending into one of said columnar members, said columnar members having at least one inwardly extending projection, said body having means for receiving said projection and for releasably trapping same in said body for retaining said locking device on said columnar member.

6. The container according to claim 5 wherein said locking device body has a groove on the circumference thereof for receiving said projection and wherein said locking device has a locking member moving into and out of said circumferential groove for releasably trapping said projection in said locking device.

7. The container according to claim 6 wherein said locking member is moved in a direction normal to said circumferential groove.

8. The container according to claim 7 wherein said locking device has a bar means extending through an opening in said locking device, said bar member having a groove containing said locking member, said groove having a surface engaging said locking member for moving said locking member into and out of said circumferential groove.

9. The container according to claim 8 wherein said bar means contains a groove with a ramp surface for moving said locking member into and out of said circumferential groove.

10. The container according to claim 6 wherein said locking device further includes means biasing said locking member into said circumferential groove.

11. The container according to claim 6 wherein said locking device includes a keyway leading to said circumferential groove and wherein said locking member extends across said circumferential groove to trap said projection in said circumferential groove or to prevent said projection from entering said circumferential groove.

12. The container according to claim 1 wherein said locking devices are held in said top and bottom members.

13. The container according to claim 1 wherein said locking devices releasably retain said container by means of projections extending from said locking devices into said columnar members.

* * * * *